United States Patent [19]

Granger et al.

[11] 4,417,883

[45] Nov. 29, 1983

[54] APPARATUS FOR CREASING PAPER USED IN THE PRODUCTION OF GYPSUM WALLBOARD

[75] Inventors: Robert L. Granger; Alva P. Alexander, Jr., both of Houston, Tex.

[73] Assignee: United States Gypsum Company, Chicago, Ill.

[21] Appl. No.: 318,521

[22] Filed: Nov. 5, 1981

[51] Int. Cl.[3] ..... B26D 3/08

[52] U.S. Cl. ..... 493/403; 493/241; 493/355

[58] Field of Search ..... 493/403, 402, 401, 161, 493/241, 355, 60

[56] References Cited

U.S. PATENT DOCUMENTS

| | | | |
|---|---|---|---|
| 221,024 | 10/1879 | Blood . | |
| 984,127 | 2/1911 | Engberg | 493/355 |
| 1,302,831 | 5/1919 | Naugler . | |
| 2,022,563 | 11/1935 | Hämmisch . | |
| 2,123,548 | 7/1938 | Sauerman | 493/241 |
| 2,244,426 | 6/1941 | Maurer . | |
| 2,311,698 | 2/1943 | Saubestre . | |
| 2,354,825 | 8/1944 | Novick | 493/241 X |
| 2,629,298 | 2/1953 | Sillars et al. . | |
| 3,027,816 | 4/1962 | Kirby et al. . | |
| 3,157,398 | 11/1964 | Zahradnik | 493/403 |
| 3,314,339 | 4/1967 | Guffy et al. | 493/403 |
| 3,587,374 | 6/1971 | Stewart | 83/56 |
| 4,141,544 | 2/1979 | Birkenmayer | 493/355 |

*Primary Examiner*—James F. Coan

*Attorney, Agent, or Firm*—Robert M. Didrick; Robert H. Robinson; Kenneth E. Roberts

[57] ABSTRACT

An apparatus for applying parallel spaced-apart creases on paper to be used as cover sheets in the manufacture of gypsum board, the parallel spaced-apart creases forming the corners of the wallboard and the distance between creases defining the thickness thereof, the apparatus being adjustable to control the depth of the creases applied so that substantially no paper material is removed during the creasing process, and the creases applied are of sufficient depth to permit sharp corners to be readily formed.

5 Claims, 8 Drawing Figures

APPARATUS FOR CREASING PAPER USED IN THE PRODUCTION OF GYPSUM WALLBOARDBACKGROUND OF THE INVENTION

1. Field of the Invention

The present invention relates to the processing of long sheets of paper, and more particularly refers to an apparatus utilized in providing parallel spaced-apart creases in paper to be utilized in the production of gypsum wallboard.

2. Description of the Prior Art

Paper to be utilized as cover sheets in the production of gypsum wallboad has conventionally been scored by a scoring apparatus which removes a small portion of the paper to provide folding edges for the paper. The scoring lines are applied parallel to each other and spaced apart a distance equal to the thickness of the gypsum board to be manufactured. A small amount of material is generally removed from the paper in the scoring process. Although the paper thus scored has been generally satisfactory for the manufacture of gypsum wallboard, the fact that a small amount of material is removed during the scoring process has reduced the strength of the paper at the scoring lines to an undesireable degree. This generally has not proved to be detrimental when thick paper is utilized. However, when thinner paper is utilized, and particularly when mineral-filled paper is utilized, the scoring of the paper which includes removing a portion thereof has been found to weaken the paper to too great an extent. However, it was found that if an insufficient amount of paper is removed during the scoring process, the creases formed in the paper are not sufficiently flexible to form a sharp corner.

SUMMARY OF THE INVENTION

It is accordingly an object of the invention to provide an apparatus for processing paper to be used in the manufacture of gypsum wallboard to provide for sharp corners to be formed at the edges of the gypsum wallboard.

It is a further object to provide an apparatus which will provide suitable crease or hinge so that the paper may be readily bent to form sharp corners during the manufacture of the gypsum board.

It is still an additional object to provide an apparatus which provides a hinge line in paper used in the formation of gypsum wallboard which is not weakened to too great an extent by virtue of the formation of the hinge line.

It is still an additional object to provide an apparatus of the type described which is reliable and which may be precisely adjusted, and which when once adjusted, will retain its adjusted condition with precision and reliability.

Other objects and advnatages of the invention will become apparent upon reference to the drawings and details of the description.

According to the invention, an apparatus is provided for applying parallel spaced-apart hinge lines to a sheet of paper to be used in the formation of gypsum wallboard. The hinge lines are provided by the use of a creasing wheel having a pair of spaced-apart creasing ribs. The creasing wheel is mounted so that is is spring loaded against a backup roll and is provided with means for adjusting the compression of the spring loading until a crease of sufficient depth is formed without removing any of the paper material and without cutting the paper material. Because the paper is only creased and not scored, the apparatus is suitable for use with very thin paper, and particularly with thin mineral-filled paper which does not lend itself for use with scoring apparatus.

DESCRIPTION OF THE PREFERRED EMBODIMENTS

Figure 1:
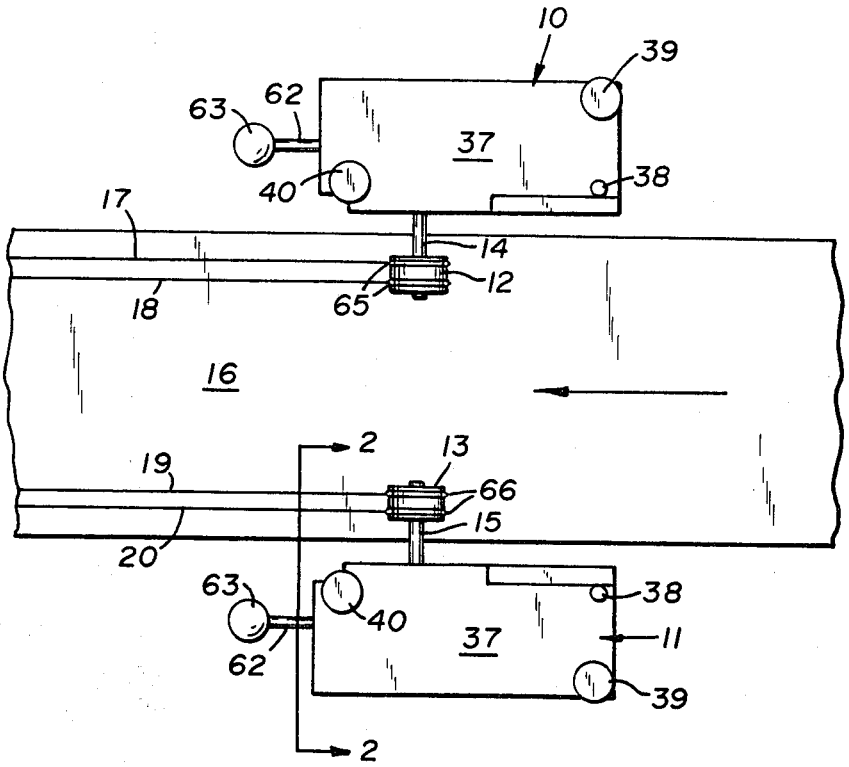
FIG. 1 is a top view of a pair of apparatuses according to the invention shown applying creases to a strip of paper to be used in the manufacture of gypsum board.
Figure 2:
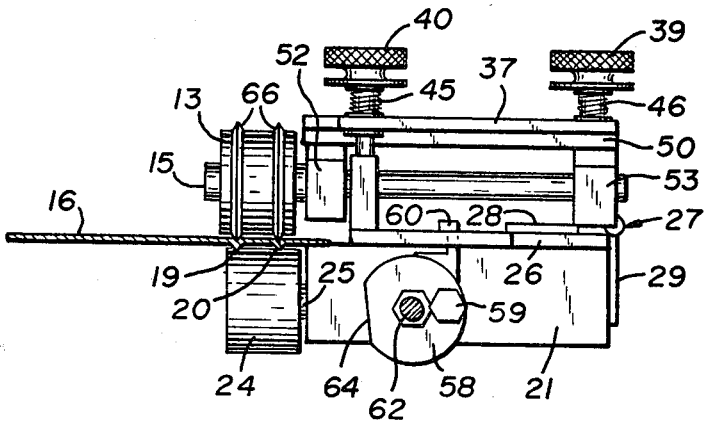
FIG. 2 is a front elevational view of one of the apparatus embodiments shown in FIG. 1.

Referring to FIG. 1, two sets of apparatus 10 and 11 are shown having creasing wheels 12 and 13 mounted on shafts 14 and 15, respectively. A paper sheet 16 is shown mounted below the creasing wheels 12 and 13 with parallel space-apart creases 17, 18, 19 and 20 being applied to the surface of the paper as it moves in a direction from right to left, as shown in FIG. 1. The application of the creases 19 and 20 are also shown in FIG. 2.

Referring to FIGS. 2, 3, 4, 5 and 6, the apparatus 11 is shown comprising a mounting plate 21 having a dove-tail slot mounted over a complementary dove-tail plate 22 for sliding transversely to the direction of movement of the paper 16. A board width adjusting screw 23 is provided for moving the mounting plate 21 transversely in order to place the creasing wheel 13 in the proper position with respect to the paper sheet 16. The creasing wheels 12 and 13 may be made of hardened steel and machined in such a way that any number of creases or impressions in the paper may be applied, thereby allowing the paper to be easily folded, and forming a good square edge on the gypsum wallboard. The creasing wheels may be machined with various spacing between the creasing ribe 65 and 66 so that the paper may be used to prepare wallboard of various thicknesses and types of edges. The scoring ribs should preferably be formed to have an angle of 90° or more between the two sides defining the ribs, as viewed in cross-section. Since the ribs merely compress the paper but do not cut out any material, a stronger edge is obtained. The wide angle of 90° or more on the scoring wheel serves two purposes: (1) it allows the paper to be folded 90° to form a square edge, and (2) it allows a large force to be applied to the surface of the paper without actually cutting through the paper. A backup roll 24 (shown in FIG. 2) is mounted on a shaft 25 which in turn is mounted in an aperture of the mounting plate 21 and serves as a support for the paper as it is being creased by the creasing ribs 65 and 66.

A base plate 26 is mounted on the mounting plate 21 by means of a hinge 27. The hinge comprises a hinge plate 28 affixed to the base plate 26 and hinge plate 29 affixed to the mounting plate 21 and hingegedly connected to the hinge plate 28 by means of a pin.

Figure 3:
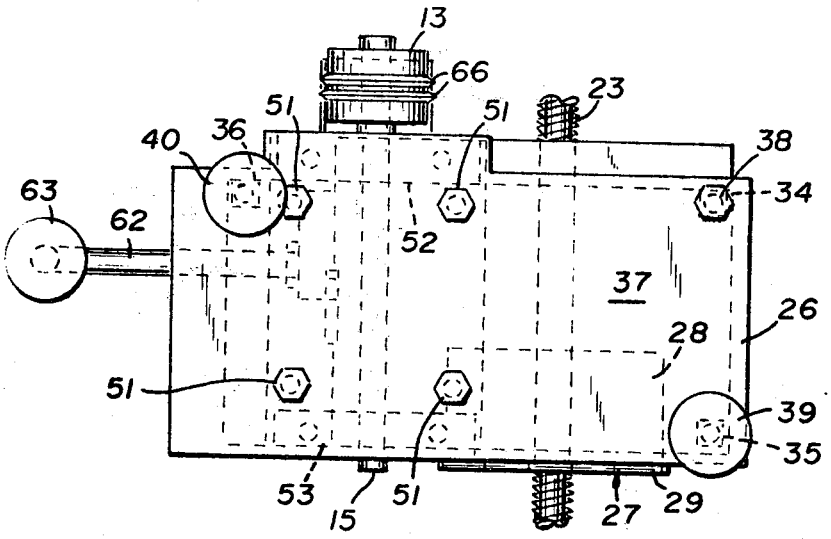
FIG. 3 is a top view of the apparatus shown in FIG. 2.
Figure 4:
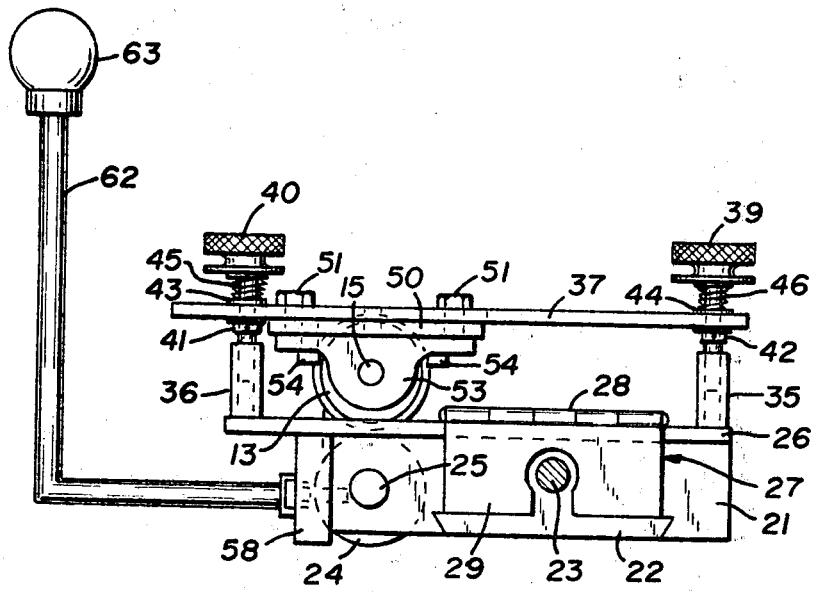
FIG. 4 is a side elevational view of the apparatus shown if FIGS. 2 and 3.

As shown in FIGS. 3 and 4, mounting or supporting posts 34, 35 and 36 are affixed to the base plate 26 by any means such as welding. A floating plate 37 is mounted on the supporting posts 34, 35 and 36. The floating plate is supported at three points, one by a semi-adjusting support pivot 38, another by a wheel tilt adjusting screw 39 which is threadily engaged in the post 35, and a third by a wheel elevation adjusting screw 40 which is threadily engaged in the supporting posts 36. Collars 41 and 42 are affixed to wheel tilt adjusting screw 39 and wheel elevation adjusting screw 40 by means of collars 41 and 42. Washers 43 and 44 are mounted over the screws 39 and 40 and are engaged on their top surfaces by compression springs 45 and 46. The wheel tilt adjusting screw 39 may be adjusted to place the floating plate 37 in a horizontal position. The wheel elevation adjusting screw 40 provides the proper spring-biasing force to bias the creasing ribs 66 against the backup roll 24.

The backup roller may be provided with a metal surface. However, it has been found that it is preferable to provide the backup roller with a surface made of a material such as an eleastic rubber or polyurethane. The rubber material serves the purpose of allowing the paper, as it creases, to be deflected downward somewhat to conform automatically to the shape of the creaser ribs. The rubber or polyurethane surface permits a greater range of adjustment for providing a good edge. It is also more forgiving in fluctuations of paper thickness. Another advantage is that the rubber or polyurethane surface permits different creasing wheels with different designs to be used with the same backup roller. As a result, to change from one product to another, only the creasing wheel itself must be changed while the same backup roller may be utilized for different creasing wheels. The only disadvantage of the rubber or polyurethane roller is the eventual wear and replacement that must be accomplished.

As shown particularly in FIG. 4, the creasing wheel 13 is mounted on the floating plate 37 by means of a bearing plate 50 affixed by means of bolts 51 to the floating plate 37. Pillow block bearings 52 and 53 are mounted by means of bolts 54 to the bearing plate 50. The shaft 15 of the creasing wheel 13 is journaled through apertures in the pillow block bearings 52 and 53.

Figure 5:
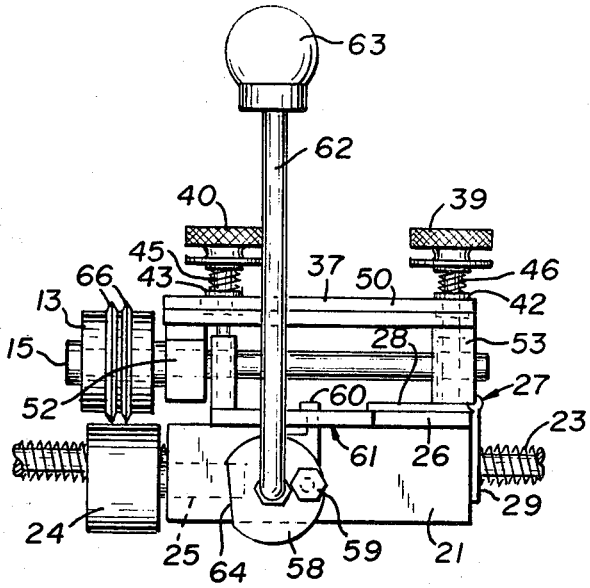
FIG. 5 is a front end elevational view of the apparatus is closed operation condition.
Figure 6:
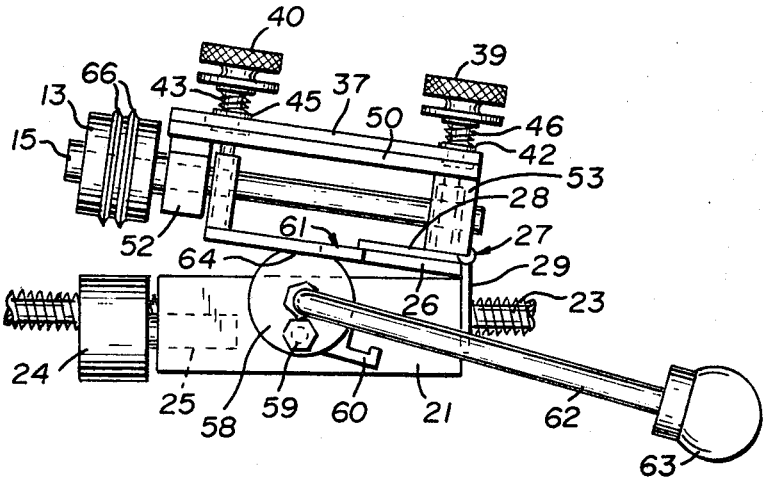
FIG. 6 is a front end elevational view of the apparatus shown in open non-operational condition.

The creasing wheel 13 is disengaged from the backup roller 24 by means of a lifting cam wheel 58 which is mounted on the mounting plate 21 by means of a pivot bolt 59. A hook clamp 60, shown in FIGS. 5 and 6, extends through a slot 61 and engages the surface of the base plate 26. The cam wheel 58 is revolved by means of a crank 62 having a knob 63. The cam wheel 58 is provided with a flat edge 64 for retaining the apparatus in the open and inoperative position. In FIG. 6 the apparatus is shown in closed and operative position with the creasing ribs 66 in engagement with the backup roller 24. In order to open the apparatus to insert or remove a sheet of paper, the crank 62, as shown in FIG. 5 is pushed to the right until it assumes the position shown in FIG. 6. During the movement, the hook 60 is disengaged from the surface of the base plate 26 and the base plate is lifted by the cam surface of the cam wheel 58. As shown in FIG. 6, the base plate 26 is resting on the flat portion 64, maintaining the apparatus in the open position.

To place the apparatus in operating position, paper is inserted between the creasing wheel 13 and the backup roller 24. Then the crank 62 is revolved to the left to assume the position shown in FIG. 5. Before placing the apparatus in operation, the wheel tilt adjusting screw 39 is adjusted to tilt the apparatus until the creasing ribs 66 uniformly engage the backup roller 24. Then the wheel elevation adjusting screw 40 is rotated until the proper spring-loading force is applied to urge the creasing rib 66 against the backup roller 24. The paper driving apparatus may then be actuated and cause the paper to be pulled between the creasing ribs 66 and the backup roller 24. In normal operation two sets of apparatuses are utilized, 10 and 11, one on each side of the paper as shown in FIG. 1.

In manufacturing gypsum board, the paper is moved over a conveyor. Then an aqueous slurry of calcium sulfate hemihydrate is poured over the paper and the edges folded over, the portion on each side of the paper formed by the spaced-apart creases becoming the edge of the gypsum wallboard.

Figure 7:
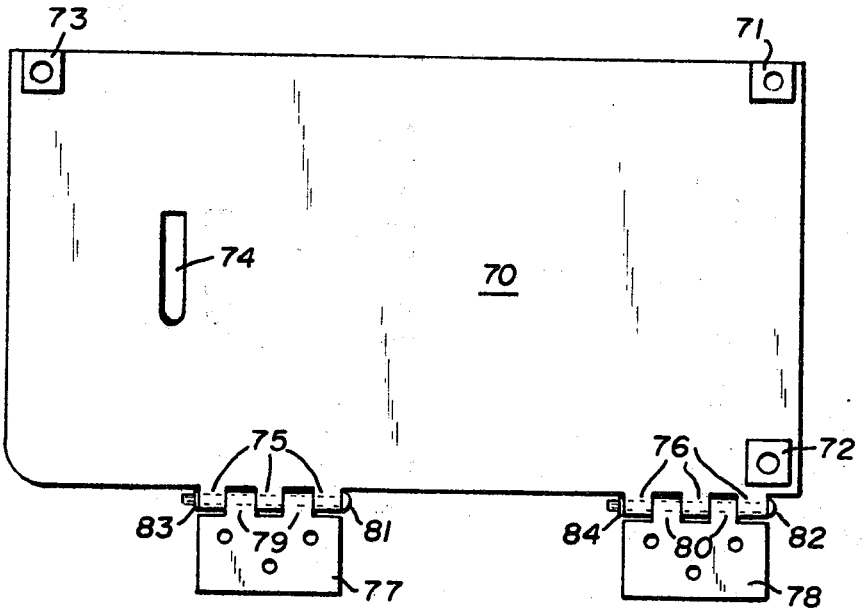
FIG. 7 is a top view of a base plate together with associated hinges representing an alternative embodiment of the invention.
Figure 8:
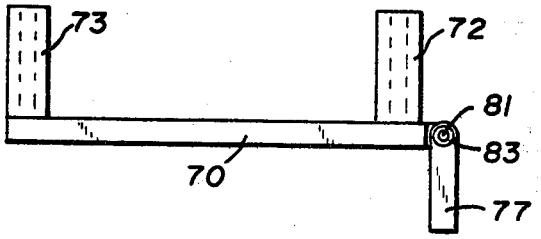
FIG. 8 is a front end elevational view of the base plate shown in FIG. 7 and associated hinges.

Referring to FIGS. 7 and 8, an alternate embodiment is shown comprising a face plate 70 having supporting posts 71, 72 and 73. A hook-receiving aperture 74 is provided for receiving the hook 60 shown in the previous FIGS. 5 and 6. However, instead of utilizing a separate hinge 27 for mounting base plate 70, the plate is provided with integral hinge tabs 75 and 76 having coaxial operings provided therein. Hinge plates 77 and 78 are provided with hinge tabs 79 and 80, respectively having coaxial apertures provided therein. Hinge pins 81 and 82 are positioned in the apertures of the hinge tabs and hinge plates and retain the hinges in operating position. Engaging washers 83 and 84 are mounted over the ends of the pins 81 and 82 to keep them in place. The hinge plates 77 and 78 are affixed to the mounting plate 21 in the same manner as the hinges 27.

Although not shown in detail, the creasing wheel 12 or 13 may be mounted on the end of an idler shaft and affixed thereto by means of a nut. The clearance between the creasing wheel bore and the idler shaft is made such that removal of the wheel is easily accomplished in the field, but the fit is sufficiently snug to prevent any wobble or free play when locked down for operation.

In operation, it has been found that it is at times desirable to position the bearing plate, and as a result the creasing wheel and shaft, to be angled slightly relative to the direction of paper travel so that the edges of the paper are actually spread outwardly to prevent paper "bunching," a phenomenon which causes inconsistent board widths.

The principal that three points define a plane is utilized for placing the scoring wheel itself in the most optimum position in order to achieve a marketable finished edge on the gypsum wallboard. To form a good edge the operator must have the facility to position each individual scoring rib independently of the other, so that one crease may be deeper or shallower than the other. This permits the newly formed edge, which has not yet been set up, to lie either in or out so that the final shape of the board meets specifications. The floating plate 37 is supported by three independently adjustable bolt columns in the manner of a surveyor's transit levelling device. The only difference is that the present creasing device floating plate utilizes a right triangle configuration for support. The plate is adjusted by three independent screws which allow the floating plate to be positioned in an infinite number of configurations. For initial set up of the device all three adjustments, 38, 39 and 40 are adjusted so that the creasing wheel ribs are in their approximate running position, and the floating plate is substantially horizontal in all directions. To raise or lower both creasing ribs simultaneously and equivalently, knob 40 is adjusted accordingly, leaving knob 39 and adjustment screw 38 in their original settings. Consequently, the floating plate rotates about a relatively horizontal axis defined by the position of adjustments 38 and 39. As the creasing wheel is raised or lowered, the elevation of the creasing wheel ribs is maintained the same. In order to move one rib deeper or shallower than the other, knob 39 is adjusted while leaving the other adjustments at their constant positions. The floating plate thus rotates about the axis defined by adjustments 38 and 40, with the rotation being accomplished by knob 39. In this manner the shaft is tilted either upwardly or downwardly causing the individual ribs to change relative elevation with respect to each other. Adjusting knob 39 requires accommodating adjustments of knob 40 in order to reset one rib back to the original position that it held prior to the adjustments.

The three supports are finely threaded bolts that screw up or down independently into the respective columns 34, 35 and 36. The columns are welded on to the base plate 26. The invidivual bolts are positioned through beveled slots in the floating plate 37 and held there by means of an arrangement of springs, washers and locking nuts, as described. The beveled slots allow the floating plate to be repositioned without any binding of the bolts. This arrangement is used primarily to facilitate ease of fabrication of the present apparatus. Alternatively a ball and socket type joint arrangement may be utilized in place of the beveled slot system. In addition to the ease of fabrication of the spring and beveled slot system, the springs also help to prevent paper cutting due to misadjustment or due to paper thickness fluctuations. The spring tend to absorb any erratic fluctuations to a greater degree than do ball and socket joints.

The present invention accomplishes passive creasing of the paper in contrast to prior art scoring devices which require independent scoring power means. The following disadvantages of the motor driven scoring device have been found to exist:

(1). Requires 2- 1 H.P. motors running constantly to drive system.

(2). Requires special design gearbox that constantly requires maintenance. Special parts must be either fabricated or ordered; either way is expensive.

(3). System is very noisy.

(4). Paper fiber cut from paper must be vacuumed out to prevent buildup. Paper fiber still collects near the scoring devices creating a housekeeping problem.

(5). Hard to set up for different products. Proper blade width, spacer width, and number of blades all must be accurate to form proper product. It is very easy to make an error.

(6). If line shuts down, operators must rapidly disconnect scoring devices to prevent blades from chipping.

(7). Scoring blades are expensive ($7.50 each) and must be sharpened or replaced routinely.

(8). System is potentially dangerous.

(9). Vibration of motor and gearbox causes need for constant attention on adjustment settings.

(10). Gearboxes are constantly causing the score line to skip, creating a non-uniform, inconsistent board.

(11). Board edge is not as strong due to actual removal of material from paper to form score.

(12). Ridging and beading of finished walls is prevalent resulting from water causing the edges to swell due to this type of fold.

(13). Initial investment for system is very high.

(14). Elaborate system to do simple task.

In comparison with the disadvantages of the prior art scoring devices, the apparatus of the present invention utilizing passive creasing of the paper are as follows:

(1). Requires no motors—paper is pulled through device with only incidental increase in power consumption.

(2). Requires no gearbox.

(3). A simple device.

(4). Easy to fabricate.

(5). Easy to maintain. Only required manintenance is to grease bearings, eventually replace polyurethane backup roller, and possibly resharpen creasing wheels.

(6). Low initial investment and low maintenance costs.

(7). Less down time due to failure (motors, gearbox or cutters in old system).

(8). No noise.

(9). No paper fiber to contend with. No vacuum lines or messy housecleaning problem.

(10). Simple changeover—just replace wheel for new product.

(11). Simple adjustment—only two adjusting knobs.

(12). No need to disengage if line shuts down.

(13). No skipping to cause inconsistent edges.

(14). No vibration, therefore adjustments can be set once with no need for readjustment later.

(15). Creasing wheels are initially more expensive than original blades, but if made from hardened steel there is very little wear.

(16). Easy and positive setup—just change scoring wheel that has product name stamped on, therefore fewer errors.

(17). Can swivel shaft relative to paper travel (plan view) to stretch paper outwardly to prevent paper "bunching."

(18). Quality of finished board is higher due to inherent differences between the scores and creases. Since the paper is only compressed to form the crease, no actual paper material is removed. Therefore, this type of edge will significantly help to reduce the problems of "ridging" and "beading" that are common in finished walls today.

The creasing apparatus of the present invention is much simpler and less costly than the forms of apparatus used in the prior art for scoring paper for use in making gypsum wallboard. The apparatus is extremely reliable and overcomes some of the problems experienced with scoring devices. The use of the creasing apparatus also permits cover sheet paper which is thinner than conventional paper to be used, since no material is removed during the creasing process. By the use of creasing wheels having creasing ribs which have sides disposed at about a 90° angle in cross section permits precise corners to be formed which define the thickness of the gypsum board. The apparatus is extremely reliable, requires very little servicing, and can easily be set up and adjusted for different thicknesses of gypsum wallboard and different thicknesses of paper. Since the apparatus can be operated without independent motors and solely by the transport mechanism utilized to move the paper, an appreciable savings in power is utilized.

It is to be understood that the invention is not to be limited to the exact details of construction, described and shown in the drawings, as obvious modifications and equivalents will be apparent to one skilled in the art.

Invention is claimed as follows:

1. An apparatus for applying parallel spaced-apart creases to paper adapted for use as cover sheets in the manufacture of gypsum wallboard, which comprises:

(1) a mounting plate, (2) a base plate, (3) hinge means having one portion connected to an edge of said base plate and the other portion connected to said mounting plate, thereby hingedly mounting said base plate on said mounting plate, wherein said hinge means comprises a pair of hinge members hingedly connected to each other by a hinge pin, one of said hinge members being affixed to said base plate and the other of said hinge members being affixed to said mounting plate, (4) supporting posts affixed to said base plate, (5) a floating plate adjustably supported by said supporting posts, wherein the means for adjustably supporting said floating plate comprise screws threadedly engaging threaded openings in said supporting posts, means affixed to said screws for engaging and supporting the lower surface of said floating plate, and means on the ends of said screws for manual engaging and adjusting, (6) adjustable means spring-loading said floating plate toward said base plate, comprising helical springs mounted over said screws, (7) a creasing wheel rotatably mounted on said floating plate having a pair of annular spaced-apart creasing ribs provided on the surface thereof, and bearings mounted on said floating plate having a shaft journaled therein, with said creasing wheel mounted on one end of said shaft, (8) a backing roller rotatably mounted on said mounting plate, (9) means for raising and lowering said base plate from operative to inoperative positions, comprising cam means rotatably mounted on said mounting plate and having a cam surface engaging the surface of said base plate, and hand operating means for revolving said cam means, wherein a portion of said cam surface is flat for engaging and maintaining said mounting plate in inoperative position, and

(10) means for locking said base plate in operative position, wherein said cam means is provided with an integral hook, wherein said base plate is provided with a slot, and wherein said hook is adapted to extend through said slot and to engage the upper surface of said base plate in locked position when said apparatus is in operative position.

2. An apparatus according to claim 1, wherein said creasing ribs have lateral surfaces in cross-section disposed at an angle of about 90° with respect to each other.

3. An apparatus according to claim 1, wherein said creasing ribs have lateral surfaces in cross-section disposed at an angle of greater than 90° with respect to each other.

4. An apparatus according to claim 1, wherein said hinge means comprises integral tabs extending from one edge of said base plate having coaxially arranged apertures, and complementary hinge members affixed to said mounting plate having tabs with coaxially arranged apertures engaged between the tabs of said base plate, and hinge pins hingedly connecting the tabs of said base plate with the tabs of said hinge plate.

5. An apparatus according to claim 1 wherein the hand operating means for rotating said cam means comprises a crank.

* * * * *

UNITED STATES PATENT AND TRADEMARK OFFICE

CERTIFICATE OF CORRECTION

PATENT NO. : 4,417,883

DATED : November 29, 1983

INVENTOR(S) : Robert L. Granger and Alva P. Alexander, Jr.

It is certified that error appears in the above—identified patent and that said Letters Patent is hereby corrected as shown below:

Column 2, line 55, change "ribe" to --ribs--.

Column 4, line 33, change "operings" to --openings--.

Signed and Sealed this

*Thirty-first* Day of *July 1984*

[SEAL]

*Attest:*

GERALD J. MOSSINGHOFF

*Attesting Officer*

*Commissioner of Patents and Trademarks*